US005148614A

United States Patent [19]

Kelly

[11] Patent Number: 5,148,614

[45] Date of Patent: Sep. 22, 1992

[54] SHOE CLOSURE STRAP APPARATUS

[76] Inventor: Michael N. Kelly, 693A Pleasant St., Norwood, Mass. 02062

[21] Appl. No.: 745,146

[22] Filed: Aug. 15, 1991

[51] Int. Cl.[5] ..... A43B 11/00

[52] U.S. Cl. ..... 36/50.1; 36/112; 36/1

[58] Field of Search ..... 36/50, 51, 52, 1, 112; 24/306, 712, 712.5, 714

[56] References Cited

U.S. PATENT DOCUMENTS

| | | | |
|---|---|---|---|
| 1,595,630 | 8/1926 | Stockton | 36/51 |
| 3,217,371 | 11/1965 | Collins | 36/50 |
| 3,279,015 | 10/1966 | Henning | 36/50 |
| 3,540,973 | 11/1970 | Johnson | 36/1 |
| 4,123,855 | 11/1978 | Thedford | 36/29 |
| 4,386,472 | 6/1983 | Shimano | 36/131 |
| 4,651,447 | 3/1987 | Sullivan | 36/50 |
| 4,733,439 | 3/1988 | Gentry | 36/50 |
| 4,744,157 | 5/1988 | Dubner | 36/88 |
| 4,907,352 | 3/1990 | Ginsberg | 36/50 |

*Primary Examiner*—Paul T. Sewell
*Assistant Examiner*—Thomas P. Hilliard
*Attorney, Agent, or Firm*—Leon Gilden

[57] ABSTRACT

A closure apparatus secured to opposing sides relative to a shoe opening overlying the tongue includes a respective right and left plate member to include a belt anchor and belt buckle respectively mounting a flexible belt web therebetween, wherein the belt web is mounted pivotally to the belt anchor and received through the belt buckle to secure the belt web in an adjustable manner through the buckle. The belt anchor and belt buckle are mounted to conventional shoe lace apertures directed through respective right and left flaps relative to the shoe opening to pivotally secure the buckle and anchor thereto.

1 Claim, 4 Drawing Sheets

SHOE CLOSURE STRAP APPARATUS

BACKGROUND OF THE INVENTION

1. Field of the Invention

The field of invention relates to shoe strap apparatus, and more particularly pertains to a new and improved shoe closure strap apparatus wherein the same is arranged for effecting selective closure of a shoe relative to a shoe opening.

2. Description of the Prior Art

Shoe strap arrangements are utilized throughout the prior art to effect closure of a shoe opening of a shoe structure. Such apparatus is exemplified in Re. Pat. No. 32,585 to Antonious wherein shoe strap securing structure is arranged for securement in association, either individually or in cooperation, with a shoe lace construction.

U.S. Pat. No. 4,476,639 to Zaccaria sets forth a shoe securement strap structure wherein the strap is directed through the shoe sole for overlying securement of the shoe upper portion.

U.S. Pat. No. 4,004,355 to Koblick sets forth a shoe device wherein strap structure is arranged for mounting of a cup-like member relative to a shoe boot.

U.S. Pat. No. 4,766,682 to Milloy, III sets forth a lace cover strap for use about an instep of a shoe to prevent untying thereof wherein the structure utilizes hook and loop fastener patches for attaching opposing ends of the strap structure.

As such, it may be appreciated there continues to be a need for a new and improved shoe closure strap apparatus as set forth by the instant invention which addresses both the problems of ease of use as well as effectiveness in construction in providing strap structure for mounting within conventional shoe lace openings within a conventional shoe and in this respect, the present invention substantially fulfills this need.

SUMMARY OF THE INVENTION

In view of the foregoing disadvantages inherent in the known types of shoe closure apparatus now present in the prior art, the present invention provides a shoe closure strap apparatus wherein the same includes a shoe web structure arranged for mounting to opposing flap sides relative to a shoe opening to permit securement of the shoe relative to an individual's foot directed therewithin. As such, the general purpose of the present invention, which will be described subsequently in greater detail, is to provide a new and improved shoe closure strap apparatus which has all the advantages of the prior art shoe closure apparatus and none of the disadvantages.

To attain this, the present invention provides a closure apparatus secured to opposing sides relative to a shoe opening overlying the tongue and including a respective right and left plate member to include a belt anchor and belt buckle respectively mounting a flexible belt web therebetween, wherein the belt web is mounted pivotally to the belt anchor and received through the belt buckle to secure the belt web in an adjustable manner through the buckle. The belt anchor and belt buckle are mounted to conventional shoe lace apertures directed through respective right and left flaps relative to the shoe opening to pivotally secure the buckle and anchor thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe closure strap apparatus which has all the advantages of the prior art shoe closure apparatus and none of the disadvantages.

It is another object of the present invention to provide a new and improved shoe closure strap apparatus which may be easily and efficiently manufactured and marketed.

It is a further object of the present invention to provide a new and improved shoe closure strap apparatus which is of a durable and reliable construction.

An even further object of the present invention is to provide a new and improved shoe closure strap apparatus which is susceptible of a low cost of manufacture with regard to both materials and labor, and which accordingly is then susceptible of low prices of sale to the consuming public, thereby making such shoe closure strap apparatus economically available to the buying public.

Still yet another object of the present invention is to provide a new and improved shoe closure strap apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an orthographic top view of a modification of the invention.

FIG. 10 is an orthographic view, taken along the lines 10—10 of FIG. 9 in the direction indicated by the arrows.

DESCRIPTION OF THE PREFERRED EMBODIMENT

Figure 1:
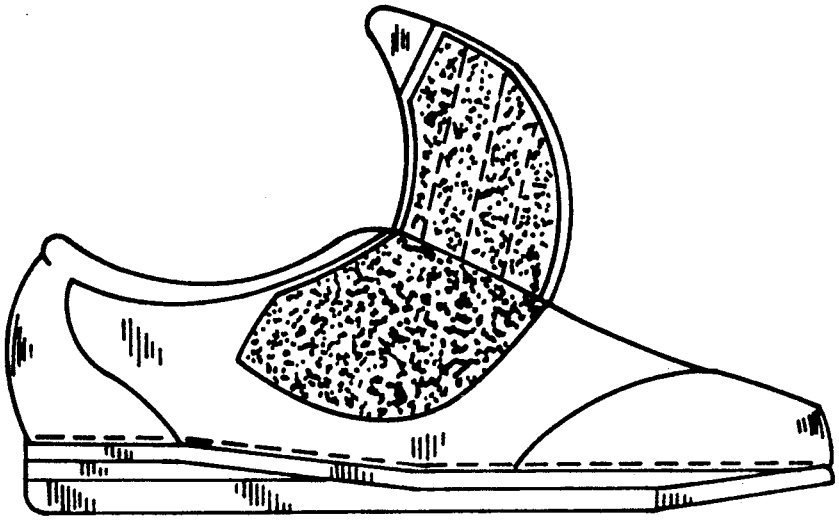
Fig 1 PRIOR ART
FIG. 1 is an orthographic side view of a prior art shoe closure strap apparatus.

With reference now to the drawings, and in particular to FIGS. 1 to 10 thereof, a new and improved shoe closure strap apparatus embodying the principles and concepts of the present invention and generally designated by the reference numeral 10 will be described.

Figure 2:
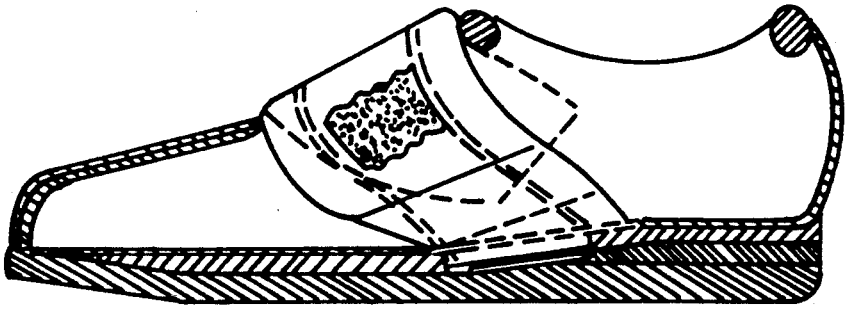
Fig 2 PRIOR ART
FIG. 2 is a further illustration of the shoe closure strap structure, as illustrated in FIG. 1.

FIGS. 1 and 2 illustrate a shoe strap structure utilizing hook and loop fasteners to secure the strap about a shoe opening, as set forth in U.S. Pat. No. 4,476,639, wherein the strap is directed through the shoe sole in use.

Figure 3:
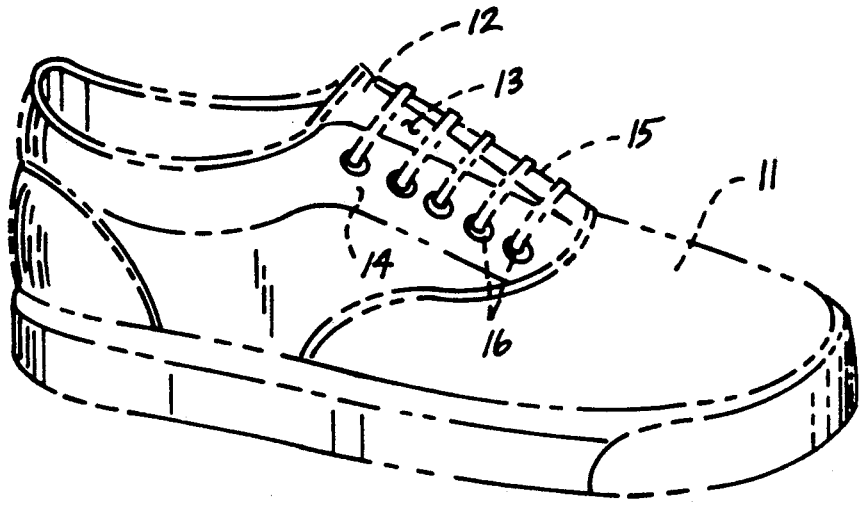
FIG 3 PRIOR ART
FIG. 3 is an isometric illustration of a conventional shoe utilizing lace closure line for effecting closure of a shoe opening.
Figure 4:
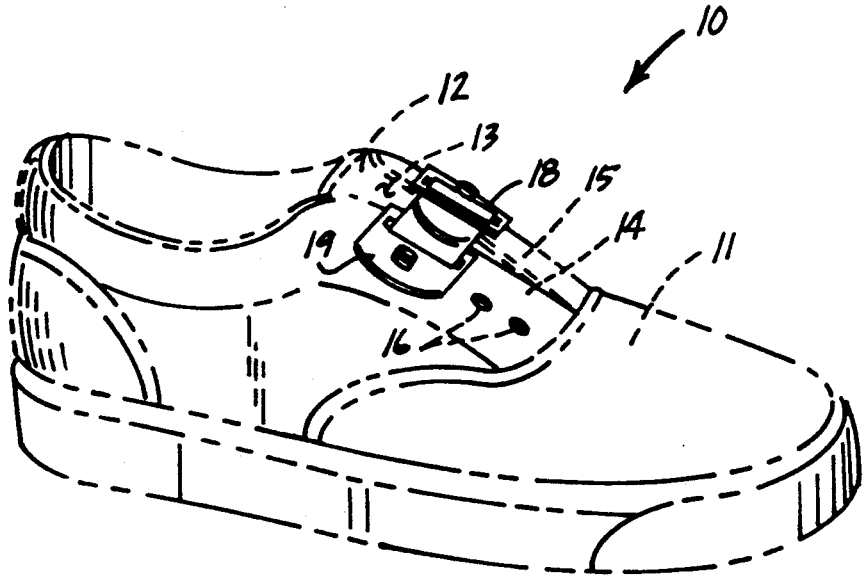
FIG. 4 is an isometric illustration of the instant invention in use.

More specifically, the shoe closure strap apparatus 10 of the instant invention is arranged for securement and mounting to a conventional shoe upper 11, as illustrated in FIG. 3, that includes a shoe tongue 12 in a conventional manner to define a shoe opening 13 between a respective right and left flap 14 and 15. The right and left flaps 14 and 15 include respective right and left flap lace openings 16 and 17 to receive a shoe lace therethrough.

Figure 5:
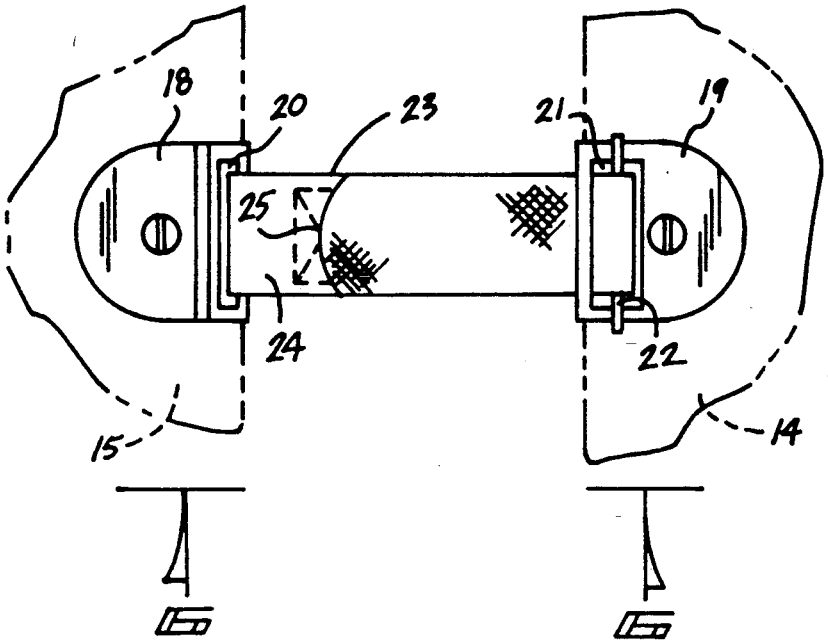
FIG. 5 is an orthographic top view of the instant invention.
Figure 6:
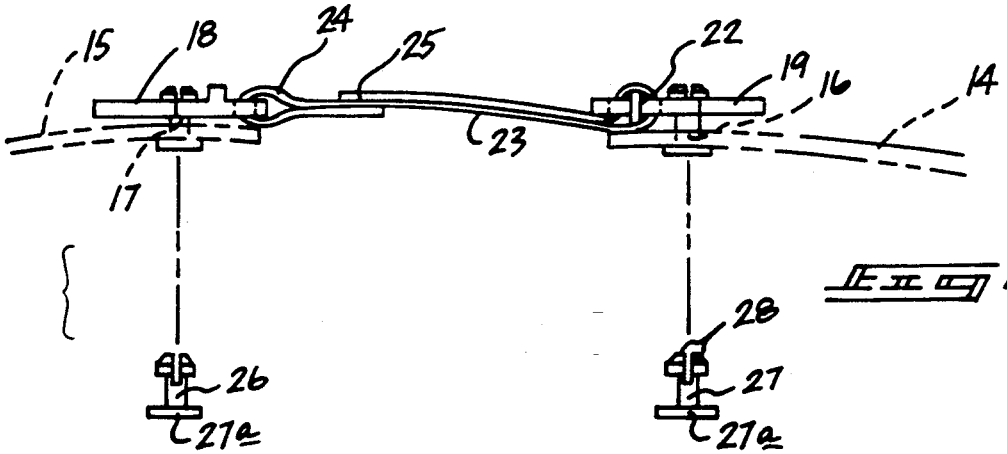
FIG. 6 is an orthographic view, taken along the lines 6—6 of FIG. 5 in the direction indicated by the arrows.

The apparatus 10, as illustrated in FIG. 5 for example, includes a belt anchor plate 18 cooperative with a buckle plate 19. The anchor plate includes an anchor plate opening 18*a*, wherein the buckle plate includes a buckle opening 19*a*, as illustrated in the FIGS. 6 and 9 for example. The anchor plate includes an anchor slot 20 that is positioned adjacent a side edge of the left flap 15, with the buckle plate 19 including a buckle slot 21 arranged adjacent the right flap edge of the right flap 14. The buckle plate includes a lock bar 22 slidably mounted within the slot in a parallel relationship thereto. A flexible belt web 23 is mounted to the anchor plate, wherein the belt web includes a securement loop 24 at a first end directed through the anchor slot 20, with a free end 25 that is woven through the buckle slot and around the lock bar 22, wherein when directed in a woven manner about the buckle slot, tension directed between the anchor plate and buckle plate effects frictional latching of the belt web 23. A respective right and left lock pin 26 and 27 of identical construction are directed through the respective right and left flap lace openings 16 and 17 received through the respective anchor and buckle plates 18 and 19. Each lock pin includes a bifurcated plurality of legs 28 mounted to a main shaft that in turn is integrally formed to a support plate 27*a*, wherein the bifurcated legs are spring biased relative to one another and when projected through each respective anchor and buckle plate opening is spread to secure the buckle and anchor plate relative to the associated right and left flap.

Figure 7:
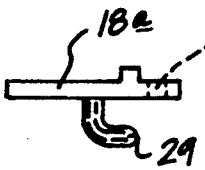
FIG. 7 is an orthographic side view of a modification of the shoe plate structure.
Figure 8:
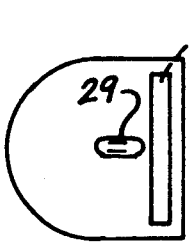
FIG. 8 is an orthographic top view of the shoe plate, as illustrated in FIG. 7.
Figure 4:
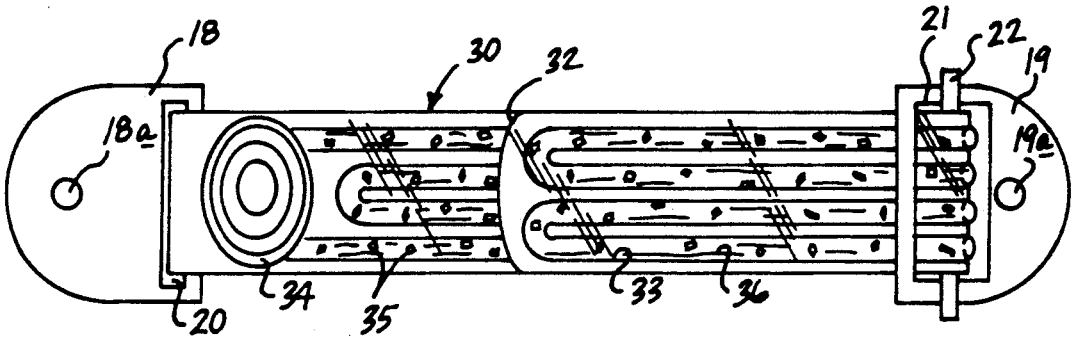
Figure 11:
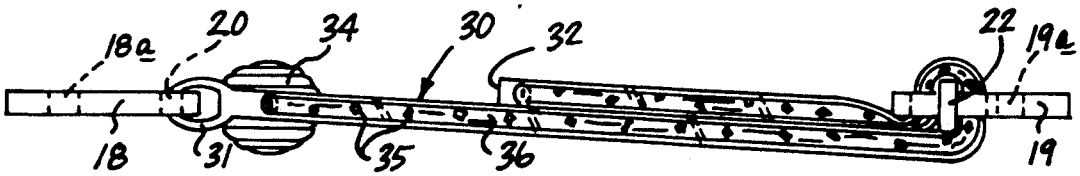

FIGS. 7 and 8 illustrate a modified plate structure, wherein the modified anchor plate utilizes a lace opening engagement hook 29 in lieu of the lock pin structure 26 and 27, wherein the hook 29 is directed through the respective lace openings.

The modified belt web 30, as illustrated in the FIGS. 9 and 10, is formed of a transparent material mounted to the anchor and buckle plates, in a manner as described above. Coextensively directed through the transparent belt web 30 is a serpentine continuous conduit 33 in fluid communication with a flexible shape retentive squeeze bulb reservoir 34 mounted to the securement loop 31 of the belt web 30. The free end 32 of the belt web 30 is directed through the buckle slot 21, in a manner as described above. The squeeze bulb reservoir 34 in fluid communication with the conduit 33 includes a reservoir of fluid 36 and of reflective glitter particles 35, whereupon application of pressure to the squeeze bulb in typical walking effecting tensioning of the belt 30, the glitter and fluid mixture is projected through the conduit 33 upon squeezing and then release of pressure applied to the squeeze bulb reservoir 34. In this manner, amusement and entertainment in use of the organization is enhanced.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe closure strap apparatus in combination with a shoe, including a show upper, the shoe upper defining a shoe opening between a right flap and a left flap, the right flap and the left flap including a plurality of respective right and left flap lace openings, wherein the apparatus comprises, an anchor plate pivotally mounted within one of said left flap lace openings, and a buckle plate pivotally mounted within one of said left flap lace openings, and the anchor plate including an anchor slot positioned adjacent the shoe opening, and the buckle plate including a buckle slot positioned adjacent the shoe opening, wherein the buckle slot includes a lock bar slidably mounted within said buckle slot in a parallel coextensive relationship within said buckle slot, and a flexible belt web, the flexible belt web including a first end, with a securement loop mounted at the first end, the securement loop secured within the anchor slot, and the second end including a free end, wherein the free end is directed through the buckle slot in surrounding relationship relative to the lock bar, and respective right and left lock means mounted to the respective anchor and buckle plate for securement of the respective anchor and buckle plate to one of said right flap lace openings and one of said left flap lace openings respectively, and each lock means includes a lock pin, the lock pin including a shank, the shank including a support plate, the support plate fixedly and orthogonally mounting the shank medially of the support plate and with the shank including a plurality of spring biased legs mounted at a distal end of the shank, wherein the spring biased legs of the respective right and left securement means are directed through the respective right and left flap and through the respective buckle and anchor plate to pivotally secure the buckle and anchor plate to the respective right and left flap, and the belt web is transparent, and wherein the belt web includes a continuous serpentine conduit contained within the belt web extending from the first end to the second end, and a flexible shape retentive squeeze bulb reservoir mounted to the belt web adjacent the first end, and fluid contained within the reservoir and within the conduit, and the fluid including a predetermined quantity of reflective glitter particles suspended within the fluid, whereupon compression of the squeeze bulb reservoir effects projection of the fluid and glitter particles throughout the conduit.

* * * * *